United States Patent [19]

Allor, Jr.

[11] 4,219,111

[45] Aug. 26, 1980

[54] POWER AND FREE CONVEYOR CONTROL SYSTEM

[75] Inventor: Bernard J. Allor, Jr., Mount Clemens, Mich.

[73] Assignee: Taylor & Gaskin inc., Detroit, Mich.

[21] Appl. No.: 882,650

[22] Filed: Mar. 2, 1978

[51] Int. Cl.[2] ..... B65G 47/46

[52] U.S. Cl. ..... 198/355; 104/88; 335/206

[58] Field of Search ..... 198/349, 350, 355; 335/206, 207, 153; 200/84; 104/88, 26 B; 214/730

[56] References Cited

U.S. PATENT DOCUMENTS

| | | | |
|---|---|---|---|
| 2,518,037 | 8/1950 | Mackechine | 198/349 X |
| 2,857,059 | 11/1959 | Goerlich et al. | 214/4 |
| 2,961,043 | 11/1960 | Rabinow | 209/74 |
| 3,100,040 | 8/1963 | Kleist | 198/355 |
| 3,126,437 | 3/1964 | Noye et al. | 104/88 |
| 3,144,926 | 8/1964 | Edelman | 198/352 |
| 3,158,710 | 11/1964 | Paglee | 104/88 X |
| 3,168,268 | 2/1965 | Bossart et al. | 246/2 |
| 3,173,533 | 3/1965 | Zuck | 235/61.11 D |
| 3,406,639 | 10/1968 | Bishop | 104/82 |
| 3,457,825 | 7/1969 | Rice | 104/88 |
| 3,506,939 | 4/1970 | Hesser et al. | 335/206 |
| 3,532,059 | 10/1970 | Frantz | 335/206 X |
| 3,598,890 | 8/1971 | Suzuki | 335/206 X |
| 3,735,300 | 3/1975 | Benner et al. | 335/206 |
| 4,038,926 | 8/1977 | Hilbeary | 104/88 |

*Primary Examiner*—Robert B. Reeves
*Assistant Examiner*—Douglas D. Watts
*Attorney, Agent, or Firm*—Burton, Parker & Schramm

[57] ABSTRACT

A control system for a conveyor having a plurality of trolley carriers movable along a path of travel and having at least one latching type reed switch whose open or closed condition is sensed in a reading station through which the trolley carrier moves, to effect some desired control function with respect to the trolley carrier. At another station, such as a writing or reset station upstream of the reading station, the switches are latched in an open or closed condition which accompanies the trolley carrier during movement of the trolley carrier along the path of travel and through the reading station. The writing station has a plurality of permanent or electromagnets conditioning each switch separately and remotely; and a reset station may be provided upstream of the writing station for separately initiating each carrier switch to an inoperable condition. Each code reader has a plurality of brushes which sweep the switches reading the condition of the switches by electrical conductivity as the trolley carrier moves along the path of travel.

19 Claims, 9 Drawing Figures

A
54
54
108
24
118
122
106
44
114
116
112
105
20
120
104
110
22a
24
118

12
126
128
124
128
126
130
132
134
24
20
22d
A
2
2
44
44
122
121d
152
144
162
156
160
142
158
148
150
146
136
120
134
144
152
121d
162
158
160
142
146

POWER AND FREE CONVEYOR CONTROL SYSTEM

BACKGROUND OF THE INVENTION

1. Field of Art

The present invention relates to a coding device for automatic conveyor routing and address systems, particularly of the power and free type; including a stationary selector and a plurality of code readers disposed at selected intervals along the conveyor for reading the selected address.

2. Description of Prior Art

Magnetic coding devices for routing systems have not always been effectively implemented to provide efficient and reliable means for routing various moving loads to specified addresses. The commonly used system for magnetic coding and reading is illustrated by U.S. Pat. Nos. 2,857,059, 3,406,639, 3,168,268, 3,735,300, 3,100,040 and 3,173,533. Patents -040, -300, -268 and -639 illustrate the most common design. A series of magnets are disposed along a moving carrier. The magnets, utilizing their various N-S configurations, are read on a lead signal at every read station. Normally these read stations comprise a plurality of reed switches in the proper permutations or associated reed switches are disposed at every station and selectively filtered. If the signal from the magnetic alignment is in the proper permutation then an operation is performed as shown in Patent -533.

In addition, the magnets have to be set manually, thus requiring the conveyor or carrier to stop in order to bias the magnets to the proper address condition (-268, -040, or -300). Because of the reliance on reed switch interpreting circuits the code readers are fixedly set to read the proper address as in Patent -300. Thus to have the code reader read a different address condition, manual changes need be performed to realign the reading elements to the proper address configuration. If this realignment is of sensitive reed switches, damage could easily occur to the device from the constant realignment. For instance, in -533, realignment of the read station would necessitate signal pickup coil 80 (FIG. 2) being transferred and secured in a different position. Since magnetic patches 14 do not carry strong magnetic flux, any realignment must be exactly located such that unwanted cross-electrical interferences or errors by the conveyor selecting mechanism are avoided.

Patents -533 and -059 illustrate the additional problem of demagnetizing substances which can produce errors in the address selecting mechanisms. The demagnetizing substances could consist of any appropriate substance afloat in the air. Often demagnetizing substances could consist of metallic beams or conduits which pick up small elements of magnetism resulting in conveyor system errors.

In addition, these magnet carrying conveyors are susceptible to outside environmental pressures common to a conveyor system. Most often these environmental pressures are collisions between carriers which can severely vibrate a load and encoded mechanism. The encoded mechanism may lose its address or is read as an incorrect address. Since severe collisions occur in a power and free system, elaborate and costly stop mechanisms must be employed or a different system of encoding the carrier's memory must be utilized.

SUMMARY OF THE INVENTION

The above recited problems, as well as many others, are eliminated by providing a novel magnetic coding device for automatic conveyor routing systems comprising one or more self-latching type read switches mounted on each moving body, such as a carrier, which are magnetically conditioned as the switches move through a writing station during travel of the carrier; and the switches maintain the condition despite movement of the carrier beyond the writing station. The condition of a switch is thereafter sensed at one or more read stations through which the switches pass during continued travel of the carrier. If a switch is latched closed, a circuit is completed at the read station. When the appropriate sequence of switches are latched closed the read station relays a signal to a performing station which performs a job downstream of the read station. Before the conveyor carriers return to the writing station, they pass by a reset station at which the switches are reset to a predetermined latched or unlatched condition.

The writing station includes selectively operable magnet means for selectively actuating the reed switches to an unlatched or latched condition. At the read station the latched condition of the switches is read by dual brushes separately engaging electrically conductive pads thereby forming one or more circuits. The impulses from the circuits are filtered through a read station control circuit and a response sent to a performing station downstream, such as a relay switch or the like. Desirably, the magnet means of the writing station may be readily selectively controlled thereby facilitating changes in permutations of open and closed switches at the writing station.

One embodiment shows a writing station having magnet means comprising a plurality of electromagnets disposed in proximity to the path of the reed switches moving through the station which will actuate the switches in the direction the electromagnets are energized. Energization of selectively actuated electromagnets occurs at a remote ground-level station or the like.

In another embodiment, the writing station has magnet means comprising a plurality of permanent magnets for selectively actuating the reed switches. The permanent magnets are selectively positioned to actuate the reed switches under control of a remotely arranged series of manually operable buttons at a remote ground level station conforming to the carrier switch alignment. Solenoids controlled by the buttons are connected to the permanent magnets such that the solenoid plungers are retracted when the buttons are depressed. When the permanent magnets are permitted to shift to a position adjacent the path of the switches, the switches are actuated to a latched condition by lines of flux sweeping the switch.

The reset station, should it be required, may be provided with reset means disposed upstream of the writing station, but after the last read station. Upon passing through the reset station each reed switch is latched to its appropriate pre-writing condition, thus enabling the switch to be biased to an addressed condition by the writing station.

BRIEF DESCRIPTION OF PREFERRED EMBODIMENTS

Figure 1:
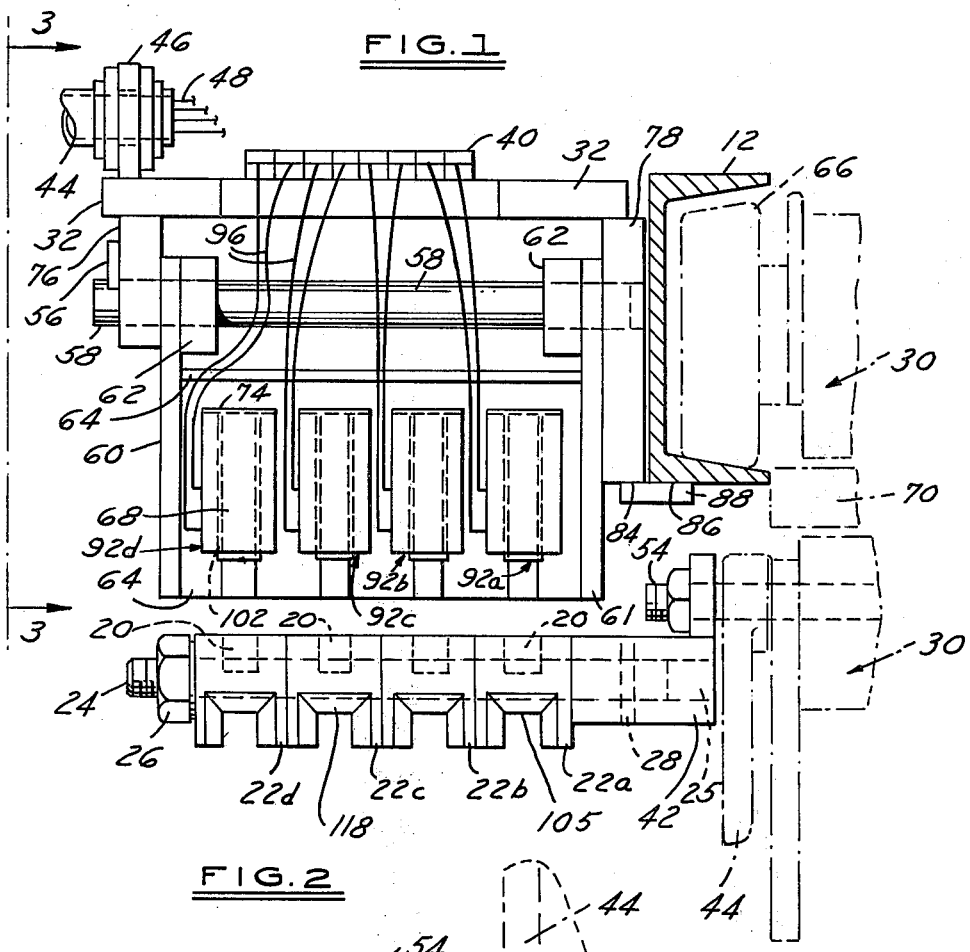
FIG. 1 is a side elevation of the electromagnetic writing station.
Figure 4:
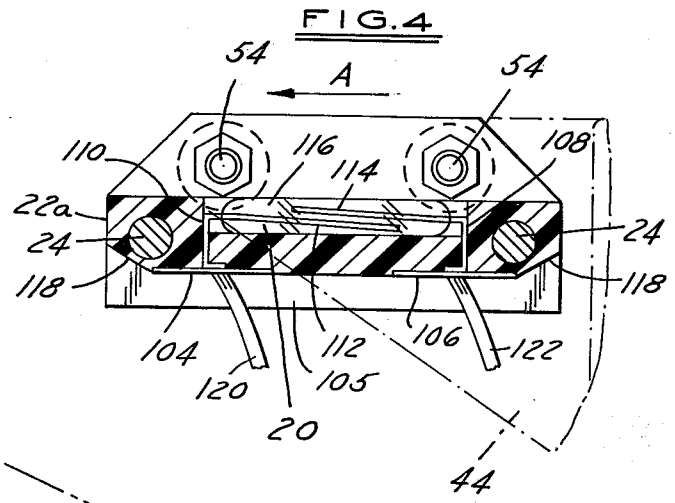
FIG. 4 is a cross-sectional view of a reed switch assembly taken along line 4—4 of FIG. 2.

In the drawings only so much of the power and free conveyor is shown as will permit orientation of the control system in relation thereto, and reference should be made to my Canadian Patent No. 942,223 for exemplification of the power and free conveyor itself, in particular FIGS. 1 and 4 thereof. A conveyor track comprising opposed U-shaped channels, one of which is shown at 12 in FIG. 1 of this application and the aforesaid Canadian Patent, supports for rolling movement therealong a plurality of moving bodies, such as trolley carriers, which my include a front trolley, a trailing trolley and an intermediate trolley as shown in FIG. 1 of the aforesaid Canadian Patent. The trailing trolley is shown in phantom outline in FIG. 1 of this application and includes a body portion 30 to which is bolted at 54 a beavertail portion 44. Wheels 66, only one of which is shown, support the trolley on track 12. A guide roller 70 maintains vertical alignment of the trolley by engaging the peripheral edge of the lower flange of track 12.

The foregoing reference numerals identifying disclosure in the drawings correspond to similar reference numerals in the aforesaid Canadian Patent and identify similar structure.

In normal practice, there will be a plurality of moving bodies, such as trolley carriers, each having a trailing trolley and one or more other trolleys from which an article is suspended or carried along the power and free conveyor track. In the drawings, only one trolley is shown, but it is to be understood by those skilled in the art that more than one such trolley is intended.

Figure 2:
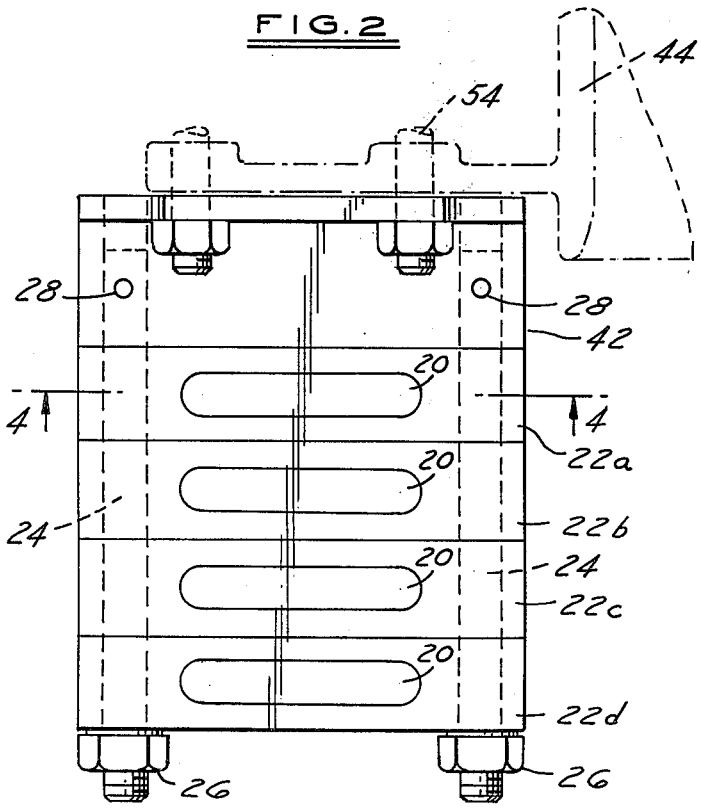
FIG. 2 is a fragmentary plan view of the switch carrier taken along the line 2—2 of FIG. 6.

While my control system may be associated with any of the trolley carriers, I prefer to use the trailing trolley of each carrier. On this trolley I mount a plurality of reed switches which are best viewed in FIGS. 1 and 2. For this purpose a bracket 42 is attached to the trailing trolley by bolts 54. A pair of shafts 24 are attached to the bracket 42 and project laterally from the trolley carrier. On th shafts are mounted a plurality of reed switch housings 22*a*, 22*b*, 22*c*, 22*d* adjacent one another and laterally outward from the trolley carrier. The inward end of shafts 24 are horizontally secured within a bore 25 in bracket 42 by locking pins 28. The outboard end of shafts 24 are screw threaded such that a washer and nut 26 can be secured against the outside switch housing 22*d*. The housings 22*a–d* are aligned along the shafts and are of sufficient thickness that cross electrical interferences are avoided. The inward switch housing 22*a* is spaced apart from the trolley 30 by bracket 42 which abuts the inner surface of switch housing 22*a*. The number of the switch housings 22*a* etc. will be dependent upon the control function to be performed as will be hereinafter evident, and by increasing or decreasing the length of shafts 24 a greater or lesser number of such housings may be accommodated.

Each switch housing 22*a–d* carries a reed switch assembly, one of which is shown in detail at 22*a* in FIG. 4. Since each individual member is similarly constructed, only one such member will be described and numbered, it being evident that all other similar members are of the same construction and will be designated by the same number. In FIG. 4 the direction of travel of the trolley carrier is shown by arrow A. Each reed switch assembly comprises a glass envelope 116 housing two reeds 114, 112 which extend substantially parallel to the path of the trolley. The reeds are connected to terminals 108, 110. The reeds are made of a material capable of relatively high residual magnetism making the switch of the "self-latching" type. The reeds themselves have overlapping contact faces lying substantially midway the length of the envelope. When a magnetic field of sufficient strength is impressed across the reeds, it will cause them to close. When the magnetic field is removed a normal reed switch will spring open, but reed switches of the self-latching type remain closed under the influence of the reeds' residual magnetism which is sufficient to retain the reeds in a closed condition, but insufficient to close them. To open the switch reeds a field of opposite direction must sweep the reeds neutralizing the switch's residual magnetism and permitting the switch reeds' inherent spring bias to open the switch.

The terminals 108, 110 extends downward from the reeds through housing 22*a* and are secured to two exposed, spaced apart contacts 104, 106 located at the bottom of channel 105 in the underside of switch housing 22*a* and are intended to be swept by brushes 120, 122 of a read station hereinafter described. Channel 105 protects the contacts from miscellaneous environmental contact and also isolates and separates the contacts of one switch from those of adjacent switches. The reed switch housing 22*a* is constructed of a non-magnetic material such as glass-filled Teflon (trademark of E. I. DuPont DeNemours & Co., Inc.) and is molded with a niche or pocket in its upper surface for receiving the reed switch envelope. The reed switch envelope is protected within the pocket by a layer of silicon which fills the pocket and protects the switch from breakage and other environmental contact.

At opposite ends of channels 105 each reed switch housing has bevelled edges 118 for directing the brushes into the channels and across contacts 104, 106. Consequently, when the reeds are in a latched condition, electric pulses from brushes or the like may be conducted through the reeds' terminals and pads to an interpreting circuit which registers the latched condition of the switch.

Figure 3:
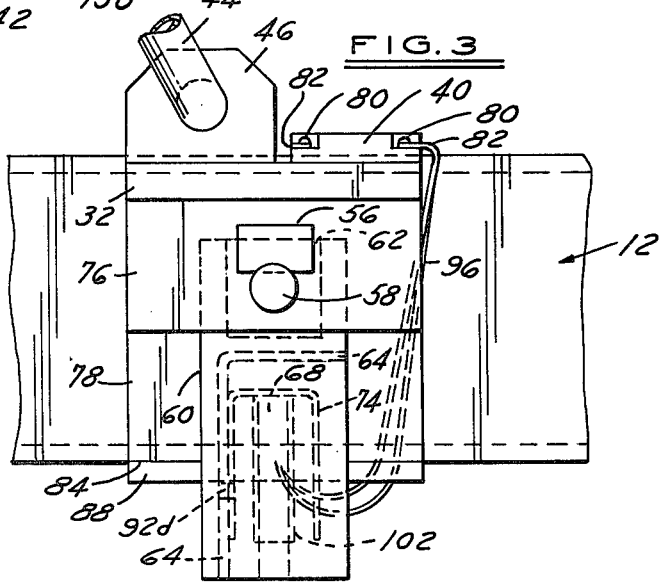
FIG. 3 is a fragmentary side elevation taken along line 3—3 of FIG. 1.

A writing station, having writing means, is shown in FIGS. 1 and 3 and is provided upstream of all associated read stations, although several writing stations may be placed along the path of carrier travel. The frame of the writing station has a horizontal locating portion 32 extending laterally from trolley 30 and is welded between and on top of vertical walls 76 and 78. Vertical wall 78 lies parallel to track 12 and is welded at its lower surface 84 to a joining portion 88 which is welded to track 12 along track surface 86 thereby providing vertical support to the writing station. A shaft 58 extends through horizontal bores in walls 76 and 78 and is secured against lateral or axial movement by a key 56 which extends through the outboard end of the shaft 58 and is bolted or otherwise secured to the side of frame member 76. Suspended and freely rotatable about shaft 58 are magnet brackets 60, 61 and bosses 62 which are welded to brackets 60, 61 for increasing the brackets' rotational strength about shaft 58. Rotating means are provided by bosses 62 and brackets 60, 61 which pivot about shaft 58 when the magnet means are abutted by objects moving in a path intersecting the plane occupied by the coil assemblies such that the coils are rotated out of the path of the abutting object. An abutting object may take the form of a distorted carrier where the carrier has been elevated several inches higher by a collision or the like. It will be noted, however, that despite the abutment by the object the switch will be actuated to an addressed condition. An inverted L-shaped backing plate 64 is secured between brackets 60 and 61. The magnet means comprises solenoid coil assemblies 92*a–d* each of which are attached to the backing plate 64 by a coil bracket 74. Each coil assembly 92*a–d* comprises a core 68 and a magnet coil 102 which are secured to the downstream side plate of 64. The lower end of the core 68 is disposed sufficiently close to the associated reed switch on the trolley carriers for actuating the reed of the switch when the trolley carrier sweeps beneath the cores.

Conduit 44 projects electrical conductors 48 into the writing station and is secured to a connector 46 through which wires 48 extend. Wires 48 are connected to a terminal 82 and secured to a terminal strip 40 by a screw 80. Terminal strip 40 transmits the coded information of wires 48 to input wires 96 which are secured to strip 40 in identical manner on the opposite side of the strip. Input wires 96 are secured to coils 102 in a manner commonly known in the art. The magnetic polarity or direction of each field and coil assembly is determined by the direction of the electrical impulses transmitted across each input wire 96. When a separable input wire 96 is charged, coil 102 and thereby core 68 of the associated coil assembly 92 will be polarized in the charged direction and as a reed switch moves therebeneath, core 68 will separably activate the reed switch to a latched or unlatched condition depending upon the direction of the charge on wire 96.

Figure 5:
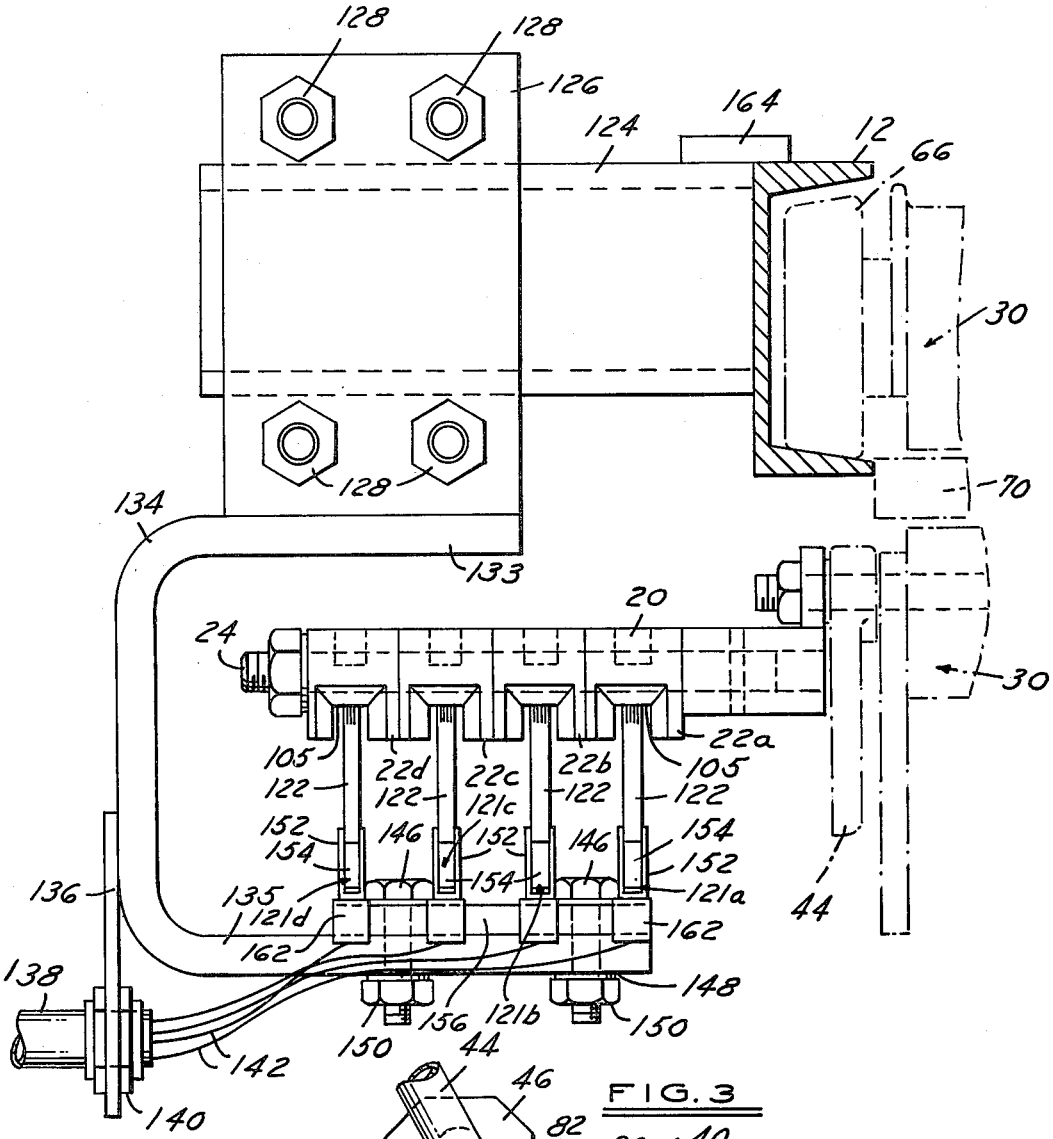
FIG. 5 is a side elevation of the read station.
Figure 6:
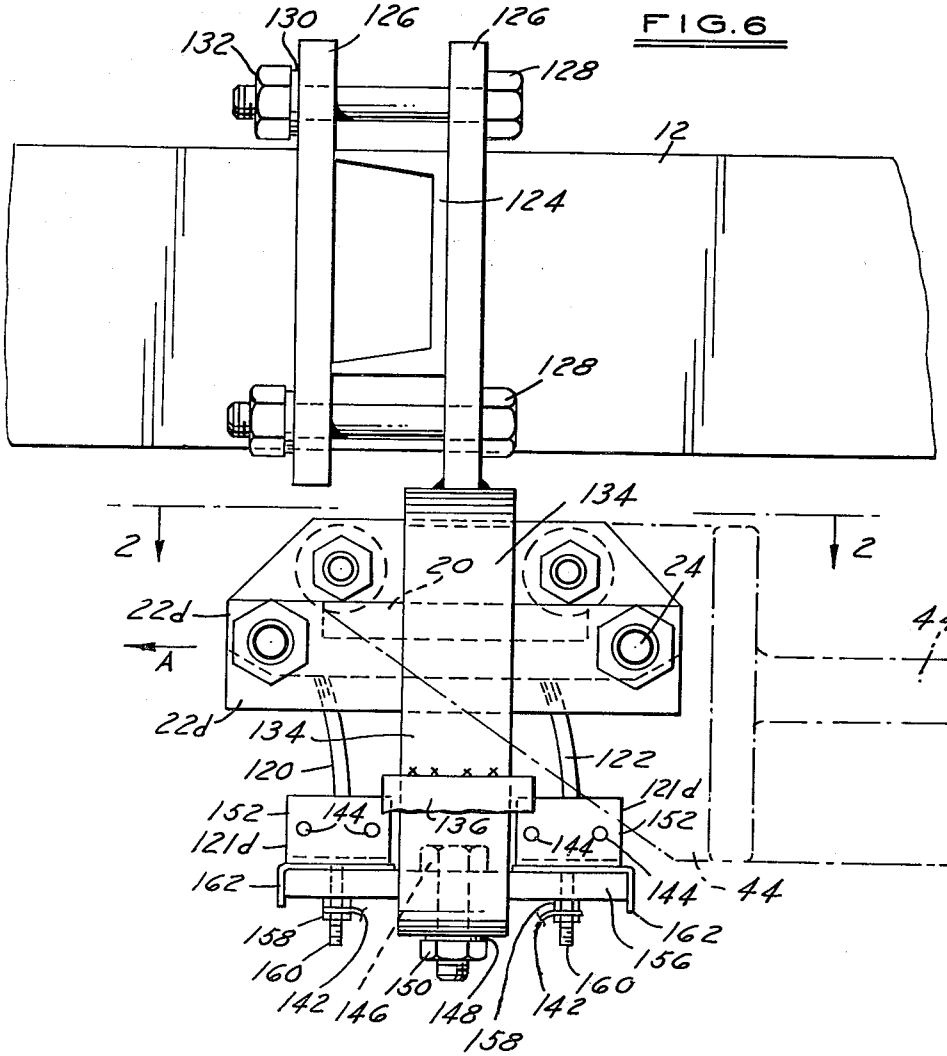
FIG. 6 is a side elevation of the read station.

A typical read station is shown in FIGS. 5 and 6 providing means for sensing the condition of each reed switch, wherein a read station support 124 is welded to track 12 by joining portion 164 similar to that described for portion 88 in FIG. 1. Read station support 124 provides a guide along which plates 126 may be adjusted for moving the read station toward or away from the conveyor track. Plates 126 are fixed against support 124 by four bolts 128, washers 130 and nuts 132 which are loosened for lateral adjustment of the plates 126. Arm 133 of a C-shaped bracket 134 is welded to one of the mounting plates 126 while arm 135 carries upstanding brush assemblies 121*a–d*. A conductor support 136 extends down from the C-shaped bracket for retaining conduit 138 and connector 140 in a laterally facing position. Input and output wires 142 extend from connector 140 and are secured to brush assemblies 121*a–d* at each terminal 158 below each brush 120, 122 as can be best viewed in FIG. 6. Each terminal 158 comprises a screw and nut assembly 160, the head of the screw securing a U-shaped bracket 152, brushes 120 or 122 and bracket 162 to Micarta board 156. Inclined retaining guides 154 are secured across the open ends of the U-shaped brackets 152 by screws 144 and restrain longitudinal travel of the brushes within fixed limits when the brushes are bent by abutment against the switch housing surfaces. Brackets 162 are provided for each pair of brushes and restrain the brushes and their U-shaped brackets 152 from rotating about the vertical axis of the brushes. The Micarta board assembly is affixed to the upper face of arm 135 by bolts 146, washers 148 and nuts 150, such that lateral movement of mounting plates 126 is transmitted to the brush assembly allowing the brushes to be moved transversely when desired, as when the reed switch housings are moved inward.

In operation, an operator selects a code at a remote station which is transmitted to the writing station for input to the next carrier. As the carrier moves beneath the writing station, the writing means such as coil assemblies 92*a–d*, will be charged to the proper magnetic direction either latching the reed switches closed or open. Should the switches be closed, the reeds' inherent residual magnetism retains the reeds in a latched condition despite travel of the carrier away from the magnetic influence of the coils. Thus written, the carrier trolley continues to travel downstream until the trolley trips an appropriate relay, not shown, upstream of a read station, signalling the read station of the approaching carrier. Normally a read station having means for sensing the condition of the reed switches is located sufficiently upstream of a side tack or work station such that the address of the carrier can be sensed and the trolley carrier switched to the side track or work station if the address of the carrier so instructs. At the read station each brush and pair of input and output wires 142 are constantly energized and consequently are awaiting passage of the trolley carrier to complete a circuit. Until the carrier passes the brushes no circuit is completed since the two brushes remain apart. As the carrier continues to move downstream, the first set of brushes 122 engage bevelled surfaces 118 of channels 105 and because of movement of the carrier bend the brushes in the direction of carrier travel. Inclined retaining guides 154 retain the brushes in a substantially upright condition such that the brushes continue to extend vertically upward. As the carrier moves to a position directly above brushes 122, brushes 122 wipe contacts 104, but not current is conducted, since brushes 120 do not wipe any conductive surface. Further travel of the carrier downstream, however, enables brushes 122 to wipe contacts 106 and brushes 120 to wipe contacts 104. All reeds 114 and 112 which are latched closed will conduct the pulsating current through the completed circuit at this time, thereby indicating the closed condition of the reeds to the computer, interpreting circuit, or the like. Should the computer find the correct code written on the carrier, a switch or the like will be actuated downstream of the read station initiating an operation or work function. After an initial read station, several additional read stations, or writing stations can be disposed downstream for continually relaying messages from remote ground level stations to performance stations along the carrier's path of travel. The FIG. 1 embodiment requires no reset station, since the coils can be polarized in a latching or unlatching condition notwithstanding the previous condition of the reed switches, permitting maximum flexibility in the code writing system and increasing the combination of messages available downstream with a fixed number of reed switches.

Figure 7:
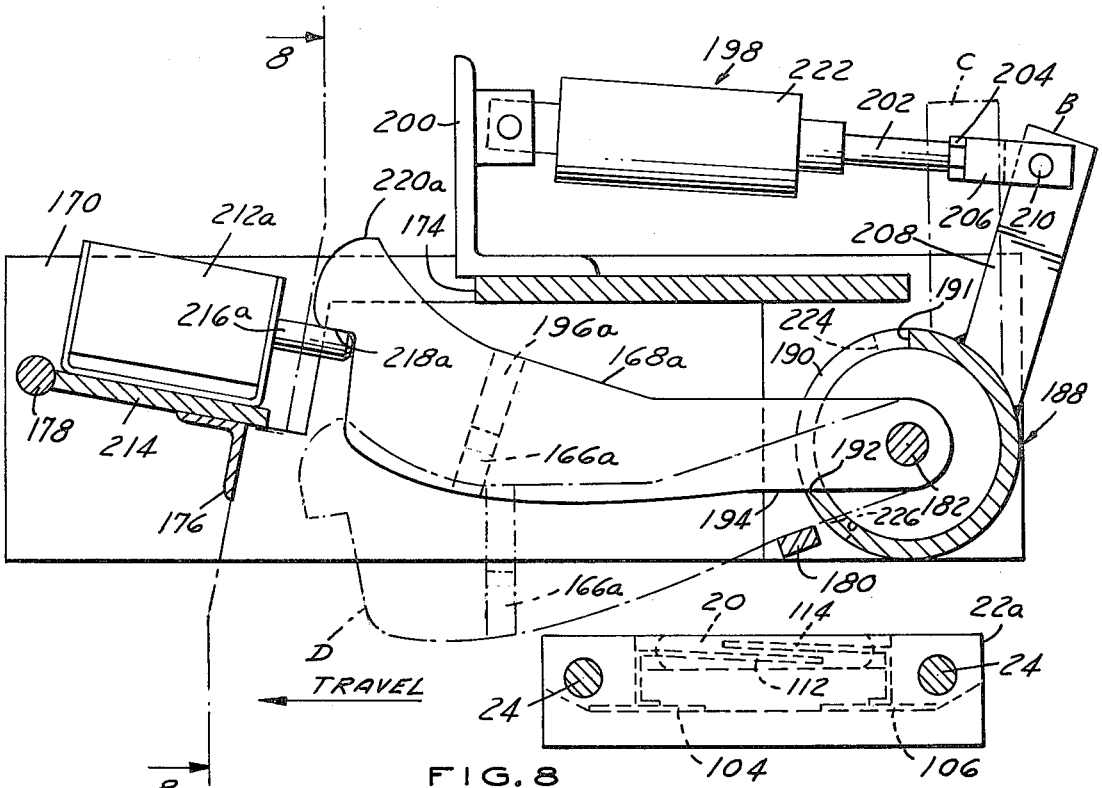
FIG. 7 is a cross-sectional end view of the permanent magnet writing station with engaging positions shown in phantom.
Figure 8:
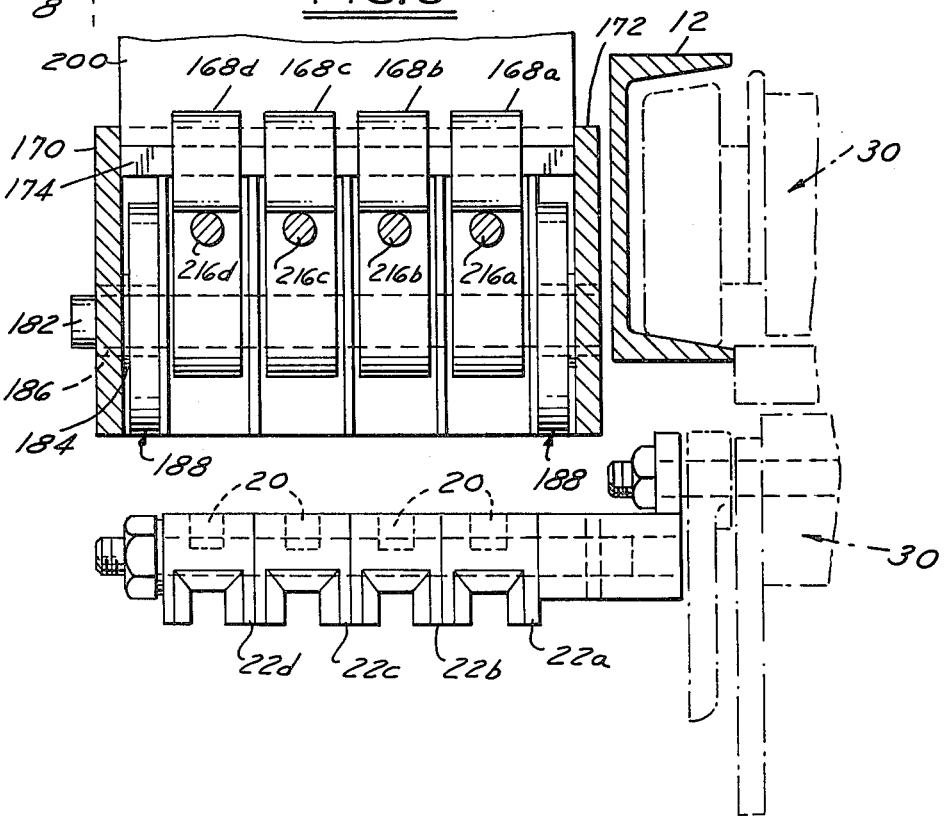
FIG. 8 is a cross-sectional side elevation taken along the line 8—8 of FIG. 7.

A second embodiment of the writing station is shown in FIGS. 7 and 8 wherein the writing station comprises magnet means having a plurality of permanent magnets 166*a–d* and camming means including cams 168*a–d*, cam drum 188, and camshaft 182, for selectively actuating the reed switches 20 as the trolley carriers travel past the writing station. FIG. 7 is a cross-sectional end view of the writing station showing the position of one of the cams 168*a* in a non-latching position in solid lines and showing the cam's latching position in phantom outline. Only one of the actuating cams will be described, since all of the cams are similarly constructed and consequently similarly numbered. To support the writing station there is shown a pair of frame walls 170, 172 extending vertically and parallel to the conveyor track 12 and are secured to the track 12 in a manner commonly known in the art. Extending between frame walls 170, 172 and perpendicular to conveyor track 12 is a cross member 174 for horizontal alignment of the station, abutment ledge 176, pivot 178, cam stop 180, and camshaft 182. Camshaft 182 is integrally secured within frame walls 170, 172 by journaling the shaft within bushings 184 and bearings 186, permitting the shaft to be freely rotated about an axis perpendicular to the travel of the carrier but within limits provided by cam drum 188 which is integrally secured to the shaft 182 and has a cam notch 190 defining the minimum and maximum rotation of drum 188. Integrally secured to camshaft 182, and also a portion of the camming means, are non-magnetic cams 168*a–d*, which are pivoted about camshaft 182 for rotational movement of the cams and periodically engaged by cam notch 190. For example, cam drum 188 supports nonmagnetic cam 168*a* in the cams' nonactuating position by cam notch 190, said notch defining two radially aligned surfaces 191, 192, radial surface 192 abutting cam surface 194 when the cam 168*a* assumes its nonactuating position. Cam notch 190 is constructed such that its width is slightly wider than the combined widths of the cams aligned along camshaft 182, but has a width less than the width of drum 188. Substantially midway the length of cam 168*a* and extending downward therethrough is a bore 196*a*, having permanent magnet 166*a* secured therein adjacent the downward facing surface of the cam 168*a*. To rotate the drum 188 and cams 168*a–d* to their actuating positions, there is provided a piston assembly 198 secured to L-shaped bracket 200, one leg of said bracket being secured to the upper surface of cross member 174. Extending outwardly from piston assembly 198 is piston 202 having a remote end 204 secured to a link 206, which is connected to lever arm 208 by pivot pin 210. Lever arm 208 is also secured to the outward surface of drum 188 in a manner commonly known in the art, by welding or the like, such that movement of lever arm 208 rotates drum 188 and cams 168*a–d* about shaft 182. Opposite cam 168*a* there is provided a solenoid 212*a* secured to a common shelf 214 supporting solenoids 212*a–d*, said shelf being pivotable about pivot 178. Solenoid 212*a* has a plunger 216*a* for abutting its respective cam surface 218*a* when cam 168*a* is in its nonactuating position. Plunger 216*a* of solenoid 212*a* is retractable in response to a signal from a remote ground level station and is reset on a signal from a second relay, not shown, downstream of the writing station. Plunger 216*a* is also retractable when abutted by cam surface 220*a*. For example, if plunger 216*a* is extended prematurely while its associated cam remains in its lowered phantom outline position, upon rotation of the cam to its upper position plunger 216*a* will abut cam surface 220*a* and retract in response to said abutment until the plunger 216*a* can extend beneath cam surface 218*a*. Downward resisting force of the solenoid is provided by the weight of shelf 214 and the plurality of solenoids secured thereto. Likewise, when shelf 214 is rotated about pivot 178 to perform repair work on a damaged solenoid or the like, the shelf can be lowered clockwise about pivot 178 to resecure the solenoids in their operable positions despite the cams 168*a–d* assuming their upper positions since plungers 218*a–d* will retract on abutting cam surfaces 220*a–d*.

In operation, as the trolley carrier initially approaches the permanent magnet writing station, cams 168*a–d*, drum assembly 188, lever arm 208 and pistion 202 are located in positions B as shown in solid lines in FIG. 7. Activation of a manual button at a remote ground level station by the operator for selecting a carrier address, will activate the appropriate solenoids thereby retracting selected plungers 216*a–d* such that the retracted plungers no longer abut cam surfaces 218*a–d*. If a particular solenoid 212*a* is not activated, the plunger 218*a* will remain extended, preventing its associated cam from rotating downward. Nevertheless, all arms 168*a–d* remain in their upper position despite retraction of selected plungers 216, since the cams continue to rest against surface 192 of drum 188. As the trolley carrier approaches the writing station, a relay, not shown, is tripped activating cylinder 222 retracting piston 202 and rotating lever arm 208 to phantom outline position C. Rotation of lever arm 208 to position C rotates drum assembly 188 counterclockwise about shaft 182. Radially aligned surfaces 191 and 192 also rotate counterclockwise assuming positions 224 and 226 respectively. Consequently, counterclockwise rotation of drum 188 permits all cams 168*a–d*, whose associated plungers have been retracted, to lower in a counterclockwise direction about shaft 182 when surface 192 assumes position 226. All freely rotating cams 168*a–d* will then abut stop 180 thereby assuming their phantom outline positions D for activating the switches 20.

As the carrier passes beneath the activated cams each cam will preferably lie just above the upper surface of the associated reed switch housing 22 for activation of the switch. Once the reeds 114, 112 of the reed switches 20 are latched, the reeds remain latched under the influence of the reeds' residual magnetisim despite travel of the trolley carrier away from the writing station.

Passage of the trolley carrier away from the writing station will trip a second relay, not shown, which again activates cylinder 222 such that piston 202 is extended to position B rotating lever arm 208 and drum 188 in a clockwise direction. Rotation of drum 188 in a clockwise direction causes surface 192 to abut cam surface 194 thereby rotating all lowered cams 168*a–d* to their upper nonactivating position. On a subsequent signal the solenoids will again be activated extending all previously retracted plungers 216*a–d* such that they again abut surfaces 218*a–d* and retain cams 168*a–d* in their upper positions. Plungers 216*a–d* remain in their extended positions until another input is received from the remote ground level station and the cycle is repeated.

Figure 9:
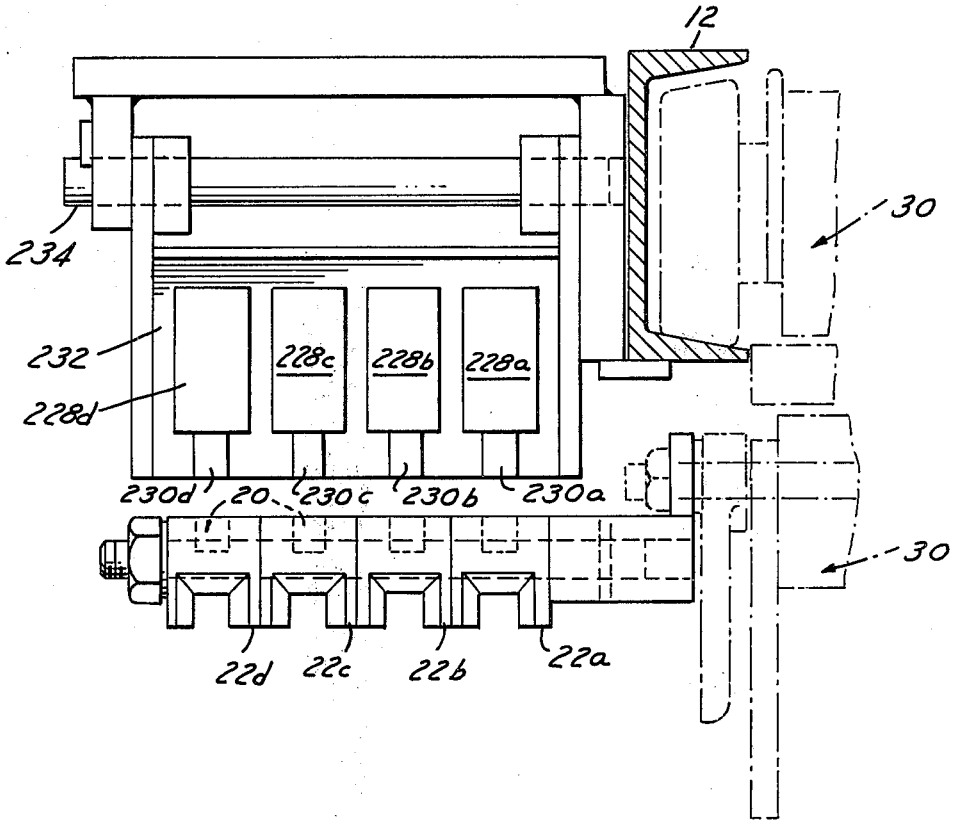
FIG. 9 is a side elevation of the reset station and conveyor carrier.

To conveniently use the second embodiment, a reset station should be provided as shown in FIG. 9 which is immediately upstream of the writing station and has reset means for resetting the switches to a pre-writing condition. FIG. 9 shows a reset station using the same construction as the writing station shown in FIG. 1, except that permanent magnet assemblies (or electromagnet assemblies) 228*a–d* have replaced coil assemblies 92. Magnet cores 230*a–d* extend downward from magnet assemblies 228*a–d* such that the magnetic fields of the cores will sweep the switches 20 activating the switch reeds to their open or closed condition depending upon which position is used for pre-writing the code. Permanent magnets 228*a–d* can be secured to the permanent magnet bracket 232 by any method commonly known in the art, but are shown here as welded. The reset station is also capable of rotating about a shaft 234 thereby avoiding an abutting object such as a distorted carrier, moving through the plane occupied by the magnets 228*a–d*.

What is claimed is:

1. A control system for a conveyor having a plurality of moving bodies, such as trolley carriers, movable along the path of travel, comprising:

at least one latching type reed switch mounted on each moving body where the switch latches open in response to a magnetic field in one direction and latches closed in response to a magnetic field in a second direction, the switch maintaining the latched position impressed by one of the magnetic fields until encountering the other magnetic field;

means along the path of the moving bodies for sensing the latched condition of each reed switch as it passes thereby; and magnet means associated with each of the switches along the path of the moving bodies upstream of the first mentioned means for selectively inducing magnetic fields of said first or second directions over the path of said associated reed switch.

2. The invention defined by claim 1 wherein each reed switch includes a pair of exposed spaced apart contacts connected to the reeds and said means for sensing the condition of the reed switch comprises a pair of flexible conductors in a control circuit supported to wipe simultaneously the exposed contacts to complete a circuit through the reeds if the reeds are closed as the moving body sweeps past such means.

3. The invention defined by claim 2 wherein the pair of flexible conductors are continually energized to complete the circuit through the reeds as the moving body sweeps past.

4. The invention defined by claim 1 wherein each reed switch includes a pair of exposed spaced apart contacts connected to the reeds and said contacts being exposed in a protective, guiding channel for guiding said means for sensing the condition of the reed switch across the exposed contacts.

5. The invention defined by claim 1 wherein said magnet means comprises a plurality of polarized electromagnets for latching the reed switches on the moving bodies open or closed.

6. The invention defined by claim 1 wherein said magnet means comprises a plurality of vertically adjustable permanent magnets, wherein the permanent magnet is lowered to latch the corresponding reed switch open or closed.

7. The invention defined by claim 6 wherein said permanent magnets are vertically shiftable when camming means comprising a drum with a notch therein and a plurality of cams are rotated counterclockwise, those cams having a solenoid plunger beneath the cam remaining in their nonactuating position and those cams with the solenoid plunger retracted, descending to their actuating position such that the permanent magnet carried within the cam can activate the reed switch therebeneath.

8. The invention defined by claim 6 wherein all permanent magnets are lowered by a central drum member and individually allowed to lower by a solenoid plunger which selects which magnets are permitted to be vertically lowered to actuating positions.

9. The invention defined by claim 7 wherein each solenoid plunger is rotatable about a common pivot for rotating each plunger out of engagement with its associated permanent magnet.

10. The invention defined by claim 1 wherein the moving body projects laterally from the path of travel and reed switches mounted on the moving body have a pair of enclosed reeds capable of retaining high residual magnetism for retaining the reeds in a latched condition when latched closed by a field in one direction and being unlatched by a field of opposite direction.

11. The invention defined by claim 1 wherein said reed switches are mounted on the moving body.

12. The invention defined by claim 1 wherein the magnet means is suspended from rotating means having a rotating member for pivoting the said magnet means about a shaft when the said magnet means is abutted by objects moving through the plane occupied by the said magnet means.

13. The invention defined by claim 1 wherein said magnet means comprises a plurality of laterally arranged spaced apart magnets, separably associated for each switch, such that one magnet does not actuate its non-respective switch.

14. The invention defined by claim 1 wherein said reed switches are fixedly enclosed in said moving body for avoidance of erroneous electrical transmission.

15. The invention defined by claim 1 wherein said reed switches are set to a non-actuated position by reset means comprising a plurality of magnets adjacent each switch and having magnet fields of identical direction for activating each switch to the same position.

16. The invention defined by claim 1 wherein the said paths of travel comprises a conveyor track upon which the moving bodies are mounted and said magnet means is secured adjacent to said tracks.

17. The invention defined by claim 1 wherein each reed switch is carried in a reed switch housing comprising a pocket for protecting the reed switch from environmental abutments and a channel portion for guiding said means for sensing the condition of each reed switch.

18. The invention defined by claim 1 wherein the latching type reed switch is mounted on each trailing moving body.

19. The invention defined by claim 1 wherein the said means for sensing the condition of each reed switch is secured to the path of travel of the moving body and is adjustably movable laterally to or from the path of travel.

* * * * *